US009900704B2

(12) United States Patent
Ma et al.

(10) Patent No.: US 9,900,704 B2
(45) Date of Patent: Feb. 20, 2018

(54) SPEAKER

(71) Applicants: Jing Ma, Shenzhen (CN); Long Zhang, Shenzhen (CN)

(72) Inventors: Jing Ma, Shenzhen (CN); Long Zhang, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 15/296,322

(22) Filed: Oct. 18, 2016

(65) Prior Publication Data

US 2017/0134862 A1 May 11, 2017

(30) Foreign Application Priority Data

Nov. 5, 2015 (CN) ..... 2015 2 0877490 U

(51) Int. Cl.

| | |
|---|---|
| ***H04R 9/06*** | (2006.01) |
| ***H04R 7/12*** | (2006.01) |
| ***H04R 7/16*** | (2006.01) |
| ***H04R 9/02*** | (2006.01) |
| *H04R 7/20* | (2006.01) |

(52) U.S. Cl.

CPC ..... *H04R 9/06* (2013.01); *H04R 7/12* (2013.01); *H04R 7/16* (2013.01); *H04R 9/022* (2013.01); *H04R 9/025* (2013.01); *H04R 7/20* (2013.01); *H04R 2209/024* (2013.01); *H04R 2400/11* (2013.01)

(58) Field of Classification Search

CPC . H04R 7/18; H04R 7/20; H04R 9/022; H04R 9/025; H04R 9/045; H04R 9/046; H04R 9/06; H04R 2209/024; H04R 2400/11

See application file for complete search history.

(56) References Cited

U.S. PATENT DOCUMENTS

| | | | | |
|---|---|---|---|---|
| 5,335,287 A * | 8/1994 | Athanas | H04R 9/027 381/403 |
| 6,404,896 B1 * | 6/2002 | Yoo | H04R 9/045 381/401 |
| 2008/0309440 A1 * | 12/2008 | Itakura | H01F 7/066 335/231 |
| 2015/0016660 A1 * | 1/2015 | Matsumura | H04R 9/06 381/415 |
| 2016/0021444 A1 * | 1/2016 | Behles | H04R 1/288 381/354 |

* cited by examiner

*Primary Examiner* — Joshua Kaufman
(74) *Attorney, Agent, or Firm* — Na Xu; IPro, PLLC

(57) ABSTRACT

A speaker is provided in the present disclosure. The speaker includes a magnetic circuit system, a vibration system and an auxiliary system suspending the vibration system above the magnetic circuit system. The magnetic circuit system comprises a yoke, permanent magnets assembled on the yoke, and a magnetic gap near the permanent magnets. The yoke comprises an upper surface for assembling the permanent magnets, a lower surface opposite to the upper surface, side surfaces connecting the upper surface and the lower surface, and communication conduits extending through the upper surface and the side surface to communicate the magnetic gap and the space outside the speaker.

9 Claims, 3 Drawing Sheets

SPEAKER

FIELD OF THE DISCLOSURE

The present invention relates to the field of electro-acoustic transducers, and in particular, relates to a speaker.

BACKGROUND

With the rapid development of science and technology, the popularity rate of the audio devices has become higher and higher. The users not only require the audio devices to play videos and audios, but also put more and more demands on the reliability of the audio devices. Especially with the advent of 3G/4G times, the mobile multimedia technology is also flourished. Some audio devices have a variety of entertainment functions, such as video play, digital photographing, game, GPS navigation and the like. All of these functions require the electronic components in the audio device to be more and more precise and compact.

In the audio device, a speaker is a commonly used electronic component, which is mainly used to play audio signals. The related speaker generally has leak holes in its backside to communicate the magnetic gap and the spaces outside the speaker. However, when the speaker is fitted to a client, the leak holes in the backside of the speaker can be easily blocked by the client, so the acoustic performance of the speaker will be negatively affected, and so is the heat dissipation of the voice coil.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiments thereof.

Figure 1:
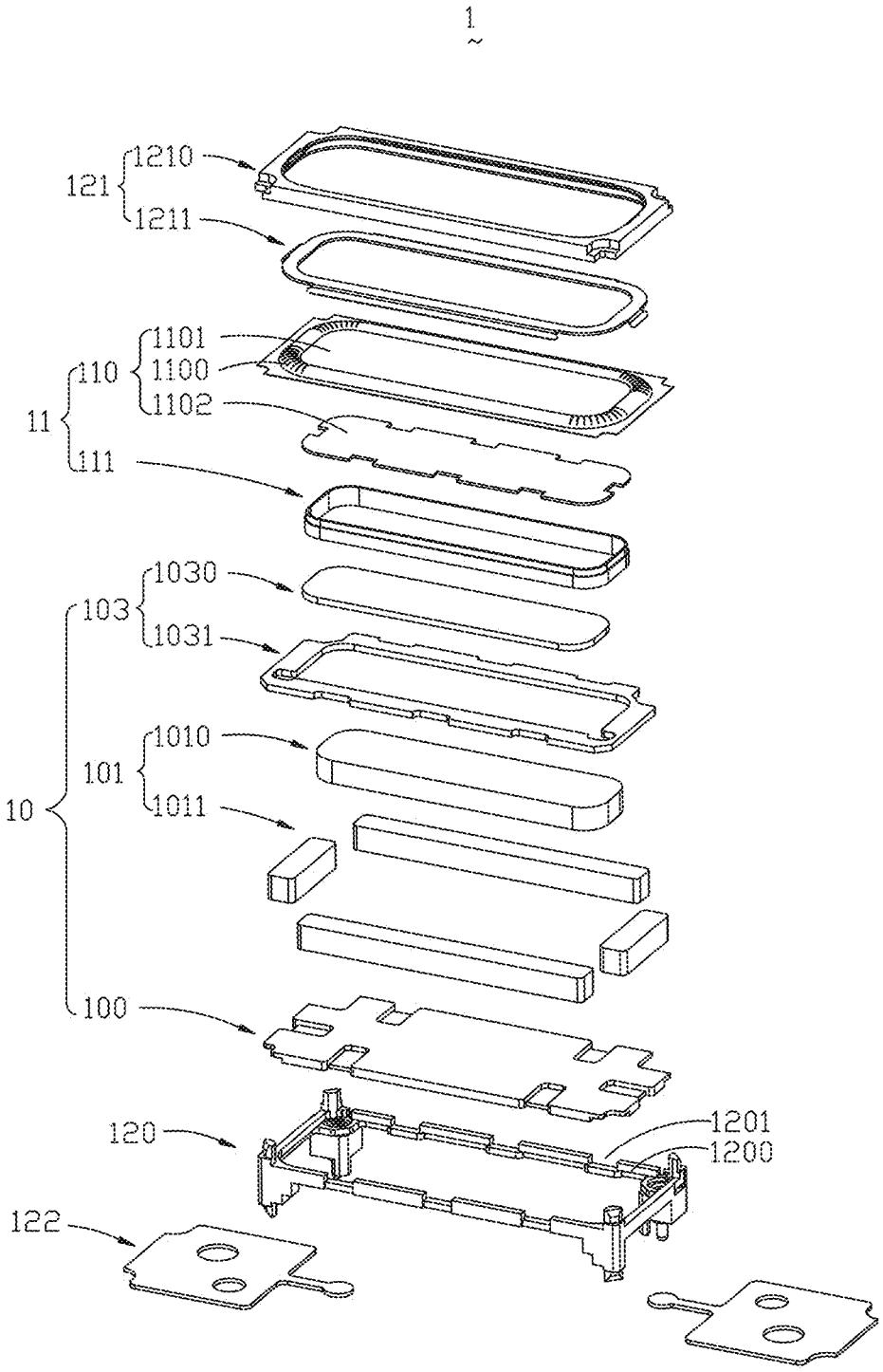
FIG. 1 is an exploded view showing the structure of the speaker in accordance with an exemplary embodiment of the present disclosure.
Figure 2:
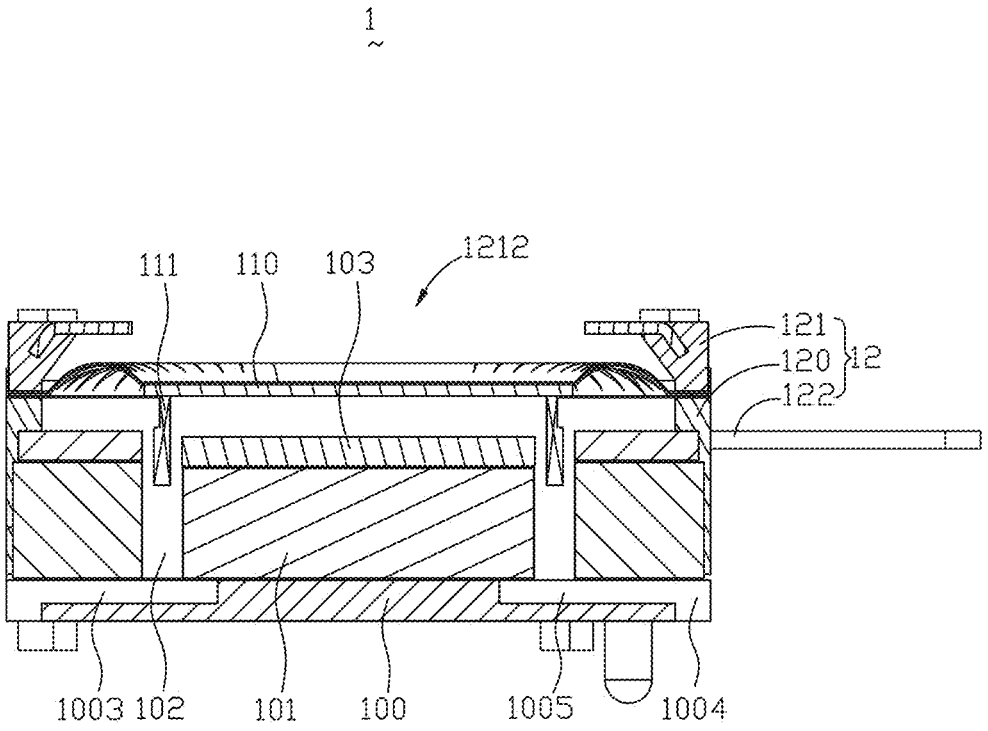
FIG. 2 is a cross-sectional view of the speaker shown in FIG. 1.

Referring to FIGS. 1-2, a speaker 1 comprises a magnetic circuit system 10 for providing magnetic field, a vibration system 11 suspended above the magnetic circuit system 10 and generating sounds by vibrating, and an auxiliary system 12 for supporting the vibration system 10 and suspending the vibration system 11 above the magnetic circuit system 10.

The vibration system 11 comprises a diaphragm 110 retained on the auxiliary system 12 and a voice coil 111 for driving the diaphragm 110 to vibrate. One end of the voice coil 111 is fixed with the diaphragm 110, and the other end is suspended in the magnetic gap 102. The diaphragm 110 comprises an edge portion 1100 with an outer perimeter secured on the auxiliary system 12 and providing elastic deformation, a middle portion 1101 disposed at the inner perimeter of the edge portion 1100, and a rigid composite layer 1102 affixed under the middle portion 1101. The end of the voice coil 111 is secured on the composite layer 1102 in a way that the area spanned by the voice coil 111 is no more than the area of the composite layer 1102. The composite layer 1102 and the middle portion 1101 can be integrally provided or can be provided as separate structures.

The auxiliary system 12 comprises a basket 120 receiving the magnetic circuit system 10, a front cover 121 covering and connected with the basket 120, and conductive terminals 122 electrically connecting the speaker 1 and the outside power. The outer perimeter of the edge portion 1100 of the diaphragm 110 is retained on the basket 120, so that the vibration system 11 can be retained on the basket 120. The outer perimeter of the edge portion 1100 is interposed between the basket 120 and the front cover 121.

The basket 120 comprises basket side walls 1200. The basket side walls 1200 of the basket 120 are provided with through holes 1201 extending through the basket side walls 1200 and communicating the space under the diaphragm 110 and the space outside the speaker 1. The through holes 1201 are used to balance the sound pressure in the space under the diaphragm 110, especially the sound pressure in the space under the edge portion 1100. Besides, the through holes 1201 are also used to dissipate the heat generated when the voice coil 111 is vibrating.

The front cover 121 comprises a plastic body portion 1210 and a rigid reinforcement 1211 injection molded with the body portion 1210 integrally. The front cover 121 is provided with a sound output hole 1212. The sound output hole 1212 is provided in the rigid reinforcement 1211. The rigid reinforcement 1211 can effectively increase the rigidity of the front cover 121 so that the thickness of the front cover 121 can be decreased under the prerequisite of guaranteeing the rigidity of the front cover 121, and so that the entire speaker 1 can be made thinner.

Figure 3:
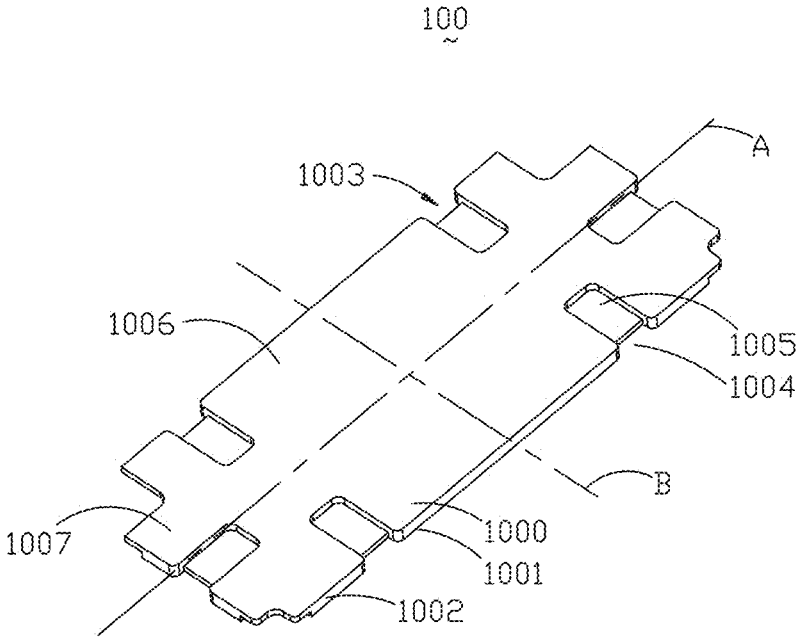
FIG. 3 is a schematic view of a yoke of the speaker shown in FIG. 1.

Also referring to FIG. 3, the magnetic circuit system 10 comprises a yoke 100, permanent magnets 101 assembled on the yoke 100, a magnetic gap 102 near the permanent magnets 101, and pole plates 103 attached on the surface of the permanent magnets 101. The yoke 100 comprises an upper surface 1000 for assembling the permanent magnets 101, a lower surface 1001 opposite to the upper surface 1000, side surfaces 1002 connecting the upper surface 1000 and the lower surface 1001, and communication conduits 1003 extending through the upper surface 1000 and the lower surface 1001, and communicating the magnetic gap 102 and the space outside the speaker. The communication conduits 1003 not only can be used to leak air in order to balance the sound pressure inside the speaker 1, but also can dissipate the heat generated by the voice coil 111 when vibrating.

The permanent magnets 101 comprise a main permanent magnet 1010 assembled in the middle of the yoke 100 and auxiliary permanent magnets 1011 disposed around the main permanent magnet 1010 and spaced apart from the main permanent magnet 1010. The pole plates 103 comprise a main pole plate 1030 and an auxiliary pole plate 1031 attached on the main permanent magnet 1010 and the auxiliary magnetics 1011 respectively. The gap between the main permanent magnet 1010 and the auxiliary permanent magnets 1011 is magnetic gap 102. In the present embodiment, the auxiliary pole plate 1031 is in the shape of ring plate, which can be injection molded integrally with the basket 120, so that the bonding strength of the auxiliary pole plate 1031 and the basket 120 can be increased and the structure stability of the magnetic circuit system 10 can be improved. In the present disclosure, the shape of the auxiliary pole plate 1031 is not limited to the shape of ring plate in the present embodiment, it can also have any other suitable discontinuous ring shape.

Each of the communication conduits 1003 comprises a cut-out groove 1004 in the out perimeter of the yoke 100 and extending through the upper surface 1000 and lower surface 1001 of the yoke 100, and a channel 1005 communicating the magnetic gap 102 and the cut-out groove 1004. The channels 1005 are formed by depressing in the direction from the upper surface 1000 to the lower surface 1001. The yoke 100 is in the shape of rectangular plate, which comprises two long axis edge portions 1006 and two short axis edge portions 1007 connecting the long axis edge portion 1006. There are four cut-out grooves 1004 in the long axis edge portions 1006 and the cut-out grooves 1004 are symmetrical two by two with respect to a center line A in the long axis direction. There are two cut-out grooves 1004 in the short axis edge portions 1007 and the cut-out grooves 1004 are symmetrical with respect to a center line B in the short axis direction of the yoke 100. Because the cut-out grooves 1004 extend through the upper surface 1000, the lower surface 1001 and the side surfaces 1002, the speaker 1 can realize simultaneous leakage from the bottom face and the side faces so that the diversity of the way of installing the speaker 1 to the client can be increased greatly.

Figure 4:
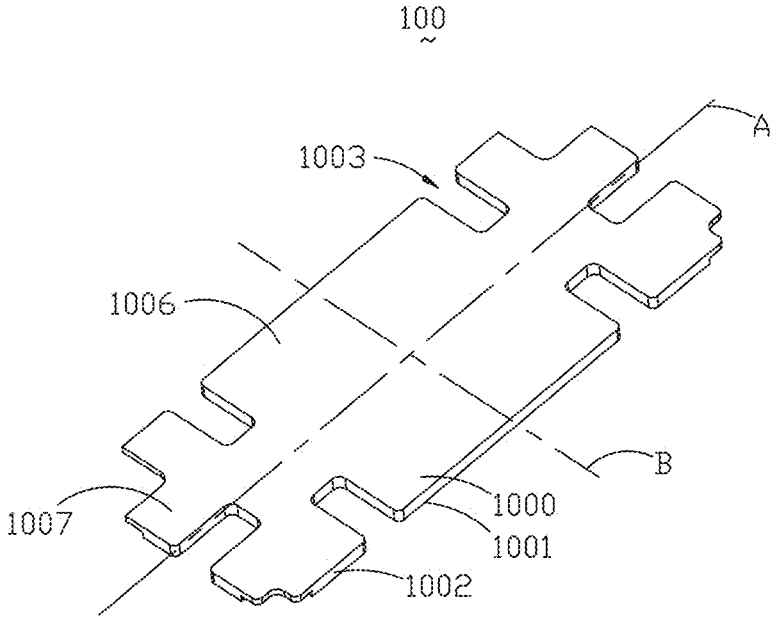
FIG. 4 is a schematic view of a yoke in accordance with another exemplary embodiment.

The communication conduits 1003 are not limited to those in the above mentioned embodiment. Specifically, as shown in FIG. 4, in another embodiment, the communication conduits 1003 extend through the upper surface 1000 and the lower surface 1001 of the yoke 100.

The yoke of the speaker are provided with communication conduits extending through the upper surface and the side surface of the yoke to communicate the magnetic gap and the space outside the speaker; the communication between the magnetic gap and the space outside the speaker 1 through the communication conduits not only can balance the sound pressure in the speaker 1 so as to improve the acoustic performance of the speaker 1, but also dissipate the heat generated when the voice coil 111 is vibrating through the communication conduits 1003. Besides, the technical problem of blocking the backside leakage when the speaker is fitted to the client can also be effectively solved.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a magnetic circuit system, a vibration system, and an auxiliary system suspending the vibration system above the magnetic circuit system;

wherein the magnetic circuit system comprises:

permanent magnets assembled on the yoke, a magnetic gap near the permanent magnets, and a yoke, which comprises:

an upper surface for assembling the permanent magnets, a lower surface opposite to the upper surface, side surfaces connecting the upper surface and the lower surface, and communication conduits communicating the magnetic gap and the space outside the speaker, wherein each of the communication conduits comprises:

a cut-out groove which is provided at the edge of the yoke and extends through the upper surface and the lower surface, and a channel which communicates the magnetic gap and the cut-out groove and depresses from the upper surface to the lower surface.

2. The speaker of claim 1, wherein the yoke is in the shape of rectangular plate, which comprises two long axis edge portions and two short axis edge portions connecting the long axis edge portion; there are four cut-out grooves in the long axis edge portions and the cut-out grooves are symmetrical two by two with respect to the center line in the long axis direction of the yoke; there are two cut-out grooves in the short axis edge portions and the cut-out grooves are symmetrical with respect to the center line B in the short axis direction of the yoke.

3. The speaker of claim 1, wherein the vibration system comprises a diaphragm retained on the auxiliary system and a voice coil for driving the diaphragm to vibrate, one end of the voice coil is fixed with the diaphragm, and the other end of the coil is suspended in the magnetic gap.

4. The speaker of claim 3, wherein the diaphragm comprises an edge portion with an outer perimeter secured on the auxiliary system and providing elastic deformation; a middle portion disposed at the inner perimeter of the edge portion; and a rigid composite layer affixed under the middle portion, wherein the voice coil is secured on the composite layer.

5. The speaker of claim 1, wherein the auxiliary system comprises a basket receiving the magnetic circuit system, a front cover covering and connected with the basket, wherein the vibration system is retained on the basket.

6. The speaker of claim 5, wherein the front cover comprises a plastic body portion and a rigid reinforcement injection molded with the body portion integrally; the front cover is provided a sound output hole, the sound output hole is provided in the rigid reinforcement.

7. The speaker of claim 5, wherein the basket comprises basket side walls, the side walls of the basket are provided with through holes extending through the basket side walls and communicating the space under the diaphragm and the space outside the speaker.

8. The speaker of claim 5, wherein the permanent magnets comprise a main permanent magnet assembled in the middle of the yoke and auxiliary permanent magnets disposed around the main permanent magnet and spaced apart from the main permanent magnet; the pole plates comprise a main pole plate and an auxiliary pole plate attached on the main permanent magnet and the auxiliary permanent magnets respectively; the gap between the main permanent magnet and the auxiliary permanent magnets is magnetic gap.

9. The speaker of claim 8, wherein the auxiliary pole plate is in the shape of ring plate, which is injection molded integrally with the basket.

* * * * *